US012760553B2

(12) United States Patent
Wang

(10) Patent No.: US 12,760,553 B2
(45) Date of Patent: Oct. 13, 2026

(54) INFLATABLE BUILDING STRUCTURE

(71) Applicant: I-Tech Machine Tool Inc., Santa Fe Springs, CA (US)

(72) Inventor: Weni Wang, Irvine, CA (US)

(73) Assignee: I-Tech Machine Tool Inc., Santa Fe Springs, CA (US)

( * ) Notice: Subject to any disclaimer, the term of this patent is extended or adjusted under 35 U.S.C. 154(b) by 0 days.

(21) Appl. No.: 19/173,734

(22) Filed: Apr. 8, 2025

(65) Prior Publication Data

US 2026/0308935 A1 Oct. 8, 2026

(51) Int. Cl.
*E04H 15/32* (2006.01)
*E04H 15/20* (2006.01)

(52) U.S. Cl.
CPC ..... *E04H 15/32* (2013.01); *E04H 2015/201* (2013.01)

(58) Field of Classification Search
CPC ..... A63G 31/12
See application file for complete search history.

(56) References Cited

U.S. PATENT DOCUMENTS 2,703,426 A * 3/1955 Barkl ..... A47L 13/502 383/66
3,586,013 A * 6/1971 Gladden ..... E04H 15/32 135/117
3,632,029 A * 1/1972 Sonner ..... B65F 1/0013 224/543
3,804,093 A * 4/1974 Fell ..... A61F 5/448 604/355
4,022,212 A * 5/1977 Lovison ..... A61F 13/70 604/391
4,062,392 A * 12/1977 Ishii ..... A45C 3/04 383/18
4,079,767 A * 3/1978 Howard ..... B65D 33/14 224/901.4

(Continued)

OTHER PUBLICATIONS

Big and Bright Inflatables, This is the foraml introduction the the "Castle Clean-out" System by Big and Bright Inflatables, Jul. 1, 2023, YouTube Video, 1:56 in duration, 4 screen shot pages.*

(Continued)

*Primary Examiner* — Michael D Dennis
*Assistant Examiner* — Matthew B Stanczak
(74) *Attorney, Agent, or Firm* — Lowe Graham Jones PLLC

(57) ABSTRACT

The present disclosure provides an inflatable building structure, comprising at least one enclosure of fluid impermeable fabric deployed above a surface that is separate from the fluid impermeable fabric to form an enclosed space bounded by the fluid impermeable fabric and the surface. The inflatable building structure comprises a cleaning assembly for draining one or more contaminants from the enclosed space bounded by the fluid impermeable fabric. The cleaning assembly comprises at least one first opening formed on an exterior of the at least one enclosure, and comprising a first attachment mechanism positioned on any of an interior and an exterior of the at least one enclosure configured to detachably secure a container for receiving the one or more contaminants from the enclosed space of the at least one enclosure.

15 Claims, 15 Drawing Sheets

(56) References Cited

U.S. PATENT DOCUMENTS 4,575,423 A * 3/1986 Alanis ..... B01D 29/111 210/167.17
4,601,315 A * 7/1986 France ..... B62B 1/14 141/231
4,615,743 A * 10/1986 Bylenga ..... B65B 67/1238 141/390
4,630,312 A * 12/1986 Milstein ..... A44B 18/00 383/117
4,664,348 A * 5/1987 Corsaut, III ..... B65B 67/1238 141/390
4,708,243 A * 11/1987 Nailon ..... A01K 97/06 206/315.11
4,802,734 A * 2/1989 Walter ..... E04H 15/22 52/2.25
4,890,652 A * 1/1990 Hoerner ..... B65F 1/1415 141/10
5,106,041 A * 4/1992 Jelincic ..... B65B 67/12 141/390
5,125,177 A * 6/1992 Colting ..... G09F 15/00 40/538
5,149,028 A * 9/1992 Blackaby ..... B65B 67/1233 248/101
5,180,125 A * 1/1993 Caveney ..... B65F 1/1415 15/257.1
5,183,339 A * 2/1993 Williams ..... B65B 67/12 141/390
5,249,318 A * 10/1993 Loadsman ..... A47C 27/082 5/713
5,265,960 A * 11/1993 Shikler ..... B65D 33/06 383/110
5,286,112 A * 2/1994 Bible ..... A45C 13/10 24/442
5,536,077 A * 7/1996 Ross ..... A41D 19/0055 312/3
5,553,933 A * 9/1996 Ross ..... B08B 15/026 134/201
5,897,208 A * 4/1999 Tokuda ..... B60N 3/083 248/101
6,079,058 A * 6/2000 Green ..... A47K 11/045 4/479
6,119,288 A * 9/2000 Hendrickson ..... A47D 13/063 5/98.1
D437,380 S * 2/2001 Gourchounian ..... D21/835
D439,946 S * 4/2001 Gourchounian ..... D21/835
6,233,767 B1 * 5/2001 Horowitz ..... A47D 13/08 5/655
6,450,186 B1 * 9/2002 Pearcy ..... E04H 15/32 135/96
6,772,779 B1 * 8/2004 Pearcy ..... E04H 15/32 135/96
D511,363 S * 11/2005 Nicholson ..... D21/814
7,267,135 B2 * 9/2007 Hardee ..... E04H 15/32 135/115
D595,802 S * 7/2009 Boulton ..... D21/835
7,744,044 B2 * 6/2010 Gabriel ..... B65F 1/1415 248/101
8,177,828 B2 * 5/2012 Anderson ..... A61F 7/0097 607/104
8,192,245 B2 * 6/2012 Deutsch ..... A47C 27/081 446/222
D717,899 S * 11/2014 Chen ..... D21/797
9,063,702 B2 * 6/2015 Deutsch ..... F16M 11/041
9,278,291 B2 * 3/2016 Scherba ..... G09B 25/04
D762,800 S * 8/2016 Scherba ..... D21/837
9,919,229 B1 * 3/2018 Bagumyan ..... A63G 31/12
D822,140 S * 7/2018 Hsu ..... D21/818
10,357,723 B1 * 7/2019 Webster ..... A63G 31/12
10,773,173 B1 * 9/2020 Bagumyan ..... A63G 31/12
10,787,313 B1 * 9/2020 Hogan ..... A47L 13/52
10,888,759 B2 1/2021 Scherba
11,127,559 B2 * 9/2021 Kim ..... H01J 37/20
11,255,063 B2 * 2/2022 Washington ..... E02D 5/80
D956,914 S * 7/2022 Qian ..... D21/818
D956,917 S * 7/2022 Qian ..... D21/818
D969,255 S * 11/2022 Pei ..... D21/820
12,366,085 B2 * 7/2025 Hanley ..... A63G 31/12
2001/0032911 A1 * 10/2001 Gabl ..... B65B 67/1205 248/99
2002/0100844 A1 * 8/2002 Green ..... B65B 67/12 248/99
2002/0117197 A1 * 8/2002 Pearcy ..... E04H 15/32 135/120.1
2003/0081865 A1 * 5/2003 Baker ..... B65D 33/1691 383/204
2004/0182866 A1 * 9/2004 Carrillo ..... B65F 1/002 220/495.06
2005/0087657 A1 * 4/2005 Dran ..... B65B 67/1238 141/391
2005/0194058 A1 * 9/2005 Hanchett ..... A63G 31/12 141/7
2005/0218674 A1 * 10/2005 Weathers ..... B65F 1/1415 100/295
2005/0236822 A1 * 10/2005 Rose ..... B60R 21/239 280/739
2006/0150590 A1 * 7/2006 Kramer ..... A47L 9/14 55/361
2006/0211507 A1 * 9/2006 Demirdjian ..... E04H 15/62 472/134
2007/0170710 A1 * 7/2007 Bouquier ..... B60R 21/239 280/739
2007/0181271 A1 * 8/2007 Earnest ..... E06B 5/025 160/368.1
2008/0008544 A1 * 1/2008 VanElverginghe ..... E04H 12/2238 406/99
2009/0149111 A1 * 6/2009 Scherba ..... A63G 9/00 446/478
2009/0211168 A1 * 8/2009 Bogar ..... A63G 31/12 52/2.17
2009/0264042 A1 * 10/2009 Chen ..... A63G 31/12 446/221
2010/0237203 A1 * 9/2010 Romero ..... B65B 67/12 383/71
2011/0147544 A1 * 6/2011 DeSanti ..... B65B 67/1205 248/95
2011/0297247 A1 * 12/2011 Deutsch ..... A47C 27/081 5/706
2012/0006442 A1 * 1/2012 Gebke ..... B32B 3/10 428/131
2012/0177306 A1 * 7/2012 DeHart ..... A01D 43/0636 383/22
2012/0299452 A1 * 11/2012 Abreu ..... A41D 19/015 312/1
2013/0152987 A1 * 6/2013 Nelson ..... E04H 15/42 135/96
2013/0343675 A1 * 12/2013 Gourchounian ..... E04H 15/64 141/10
2014/0033440 A1 * 2/2014 Tyree ..... A47C 27/064 5/724
2015/0051007 A1 * 2/2015 Weekes ..... A63G 31/12 472/134
2015/0148141 A1 * 5/2015 Thompson ..... A63G 31/12 472/134
2016/0244259 A1 * 8/2016 Zugel ..... B65F 1/1415
2017/0225070 A1 * 8/2017 Baks ..... A63F 13/214
2019/0049027 A1 * 2/2019 Bais ..... A63H 23/10
2021/0148135 A1 5/2021 Ward et al.
2021/0348351 A1 * 11/2021 Washington ..... E02D 5/80
2021/0355705 A1 * 11/2021 Harris ..... E04H 15/62
2025/0084697 A1 * 3/2025 Cook ..... A63G 31/00
2026/0139511 A1 * 5/2026 Smith ..... E04H 15/20

OTHER PUBLICATIONS

Full page screen capture of Castle Clean-out System by Big & Bright Inflatables, retrieved from the Internet at https://www.youtube.com/watch?v=E_Lu8OeKo5U on Apr. 3, 2025, 1 page.

(56) References Cited

OTHER PUBLICATIONS

Full page screen capture of New Bounce House Cleaning System short, jumporange. com, retrieved from the Internet at https://www.youtube.com/shorts/jijKvJnW6Xw on Feb. 25, 2025, 1 page.
Printscreen of video showing cleaning of a bounce house, retrieved from the Internet at https://www.youtube.com/shorts/31MbJCJbTlg on Apr. 8, 2025, 1 page.

* cited by examiner

INFLATABLE BUILDING STRUCTURE

TECHNICAL FIELD

The present disclosure relates to inflatable structures, and more particularly to an inflatable building structure having an enclosure inflated over a surface. The inflatable building structure is especially adapted for use as a playhouse for children, a greenhouse, or a building primarily utilized for the temporary shelter of people, recreational activities, or other space-efficient purposes requiring a lightweight, portable, and easily deployable structure.

BACKGROUND

The background description includes information that may be useful in understanding the present invention. It is not an admission that any of the information provided herein is prior art or relevant to the presently claimed invention, or that any publication specifically or implicitly referenced is prior art.

Inflatable playhouses are widely popular among children and their caregivers due to their portability, ease of setup, and entertainment value. These structures typically consist of a large, air-filled structure made from durable, flexible, and puncture-resistant materials such as PolyVinyl Chloride (PVC) or nylon-based fabrics. They provide children with a safe, fun, and interactive space for recreational activities. Many of these playhouses are designed to simulate various environments, such as castles, forts, or houses, and can be used indoors or outdoors. While inflatable playhouses offer a significant amount of enjoyment, they also come with various challenges related to maintenance, cleanliness, and safety. Given that inflatable playhouses are often used in outdoor settings, they are frequently exposed to dirt, dust, leaves, and other environmental contaminants that can accumulate inside the structure. Additionally, children, in their play, may bring in dirt from the outside, creating a need for periodic cleaning and maintenance of the playhouse.

One of the primary challenges with inflatable playhouses is that they often lack an efficient means of cleaning and maintaining a hygienic environment inside the structure. Traditional inflatable playhouses are designed to be easily set up and deflated, but this ease of setup does not always translate into ease of cleaning. Cleaning can be a cumbersome task, particularly when debris and dust accumulate in areas that are difficult to access. This problem is especially prominent in larger inflatable playhouses where users may not have easy access to the interior space for regular cleaning.

Furthermore, certain inflatable playhouses are made of materials that may not be suitable for frequent or aggressive cleaning, potentially causing damage or wear over time. In addition, there are hygiene concerns when playhouses are shared by multiple children, as contamination such as dust, dirt, or even potential allergens can build up inside the playhouse. In such cases, regular cleaning is essential to maintain the overall health and safety of the children using the playhouse. However, many current designs of inflatable playhouses do not incorporate any systems or mechanisms to help with debris removal during or after play sessions.

While certain inflatable structures, such as bounce houses or tents, are equipped with mesh windows or doors to allow air circulation, a view to the exterior, and to prevent the buildup of excessive heat or humidity, they do not provide a practical solution for removing dust, dirt, or debris that may accumulate inside. In some cases, inflatable playhouses have removable mats or cushions that can be cleaned separately, but these solutions do not address the underlying issue of contaminants and debris present inside the playhouse itself. Some inflatable playhouses may incorporate a filtration system to prevent dust or debris from entering the structure from the outside. However, these systems do not provide an effective solution to the problem of contamination that occurs inside the playhouse during use, as they do not offer a means for actively collecting or removing debris once it has entered the play area through a variety of means, including by being tracked in by the users of the inflatable structure.

There is, therefore, a significant need in the art for an effective solution to the problem of dust, debris, and other contaminants accumulating inside inflatable structures. Existing cleaning techniques are often insufficient to maintain a clean, safe, and hygienic environment within these structures. There is a need for an innovative and practical solution that allows for easy removal and containment of contaminants without the need for extensive manual cleaning, which can be time-consuming and inconvenient.

SUMMARY

This section is provided to introduce certain objects and aspects of the present disclosure in a simplified form that are further described below in the detailed description. This summary is not intended to identify the key features or the scope of the claimed subject matter.

An object of the present disclosure is to provide an inflatable building structure with an integrated cleaning mechanism that can collect and contain dust, debris, or other contaminants within a detachable bag, thereby preventing these contaminants from spreading or accumulating inside the structure.

Another object of the present disclosure is to provide an inflatable building structure configured to receive a detachable bag for efficient removal and collection of the contaminants. The detachable nature of the bag makes it simple to remove, empty, and clean as needed, offering a convenient and efficient means for maintaining the cleanliness of the inflatable building structure.

Another object of the present disclosure is to provide an inflatable building structure that incorporates a detachable garbage or contaminant collection bag. This bag is specifically designed to collect dust, debris, or other contaminants that accumulate inside the inflatable building structure. The bag is strategically configured with the structure to capture and contain these contaminants without interfering with the utility of the structure.

In one aspect, the present disclosure provides an inflatable building structure that may be adapted for use as a playhouse for children, a greenhouse, or a building primarily utilized for the temporary shelter of people, recreational activities, or other space-efficient purposes requiring a lightweight, portable, and easily deployable structure. The inflatable building structure includes at least one enclosure made of a fluid impermeable fabric deployed above a surface that is separate from the fluid impermeable fabric to form an enclosed space bounded by the fluid impermeable fabric and the surface. The inflatable building structure includes a cleaning assembly for draining one or more contaminants from the enclosed space bounded by the fluid impermeable fabric. The cleaning assembly includes at least one first opening formed on an exterior of the at least one enclosure. The cleaning assembly includes a first attachment mechanism positioned on an interior of the at least one enclosure configured to detachably secure a container for receiving the one or more contaminants from the enclosed space of the at least one enclosure.

In some embodiments, the cleaning assembly may include at least one second opening formed on an exterior of the at least one enclosure to allow a user to enter the enclosed space and transfer the one or more contaminants to the container.

In some embodiments, the at least one enclosure may include one or more bouncing surfaces enclosed by a plurality of walls.

In some embodiments, the at least one first opening may be formed on an outer surface of at least one of the plurality of walls. The first attachment mechanism may be positioned at an inner surface of the at least one of the plurality of walls.

In some embodiments, the at least one second opening may be formed on an outer surface of at least one of the plurality of walls to allow the user to enter or exit the one or more bouncing surfaces.

In some embodiments, the first attachment mechanism may include one or more hook-and-loop fastening elements (i.e., Velcro straps) attached to the inner surface of the at least one of the plurality of walls.

In some embodiments, the attachment may be accomplished through the use of hook-and-loop fastening elements (i.e., Velcro straps), however, one of ordinary skill in the art will appreciate that various means for attachment offer equivalent functionality, including but not limited to buttons, snaps, hooks, and the like.

In some embodiments, the at least one first opening may be sized to substantially prevent the user from entering or exiting the one or more bouncing surfaces therefrom.

In some embodiments, the first attachment mechanism may be configured to detachably secure at least one door adapted to close the at least one first opening when the container is detached from the first attachment mechanism.

In some embodiments, the at least one second opening may be positioned on the outer surface of the at least one of the plurality of walls such that an edge of the at least one second opening is substantially coplanar with the one or more bouncing surfaces, with a length sufficient to enable removal of the one or more contaminants from the one or more bouncing surfaces.

In some embodiments, the at least one first opening may include a second attachment mechanism positioned on any of an exterior or an interior of the at least one door to facilitate the first attachment mechanism in detachably securing the container.

In some embodiments, the second attachment mechanism may include one or more hook-and-loop fastening elements (i.e., Velcro straps) attached to any of the exterior and interior of the at least one door.

In some embodiments, the container may include one or more third attachment members configured to securely attach with the first attachment mechanism and the second attachment mechanism.

In some embodiments, the one or more third attachment members may be positioned at any of an inner surface and an outer surface of the container.

In some embodiments, the container may include at least one of a bag, a pouch and a garbage disposal bag.

In some embodiments, the at least one enclosure may be configured to receive a fluid from an inflator device to form the enclosed space comprising the one or more bouncing surfaces enclosed by the plurality of walls.

Various objects, features, aspects and advantages of the inventive subject matter will become more apparent from the following detailed description of preferred embodiments, along with the accompanying drawing figures in which like numerals represent like components.

BRIEF DESCRIPTION OF THE DRAWINGS

The accompanying drawings are included to provide a further understanding of the present disclosure, and are incorporated in and constitute a part of this specification. The drawings illustrate exemplary embodiments of the present disclosure and, together with the description, serve to explain the principles of the present disclosure.

DETAILED DESCRIPTION

The following is a detailed description of embodiments of the disclosure depicted in the accompanying drawings. The embodiments are in such details as to clearly communicate the disclosure. However, the amount of detail offered is not intended to limit the anticipated variations of embodiments; on the contrary, the intention is to cover all modifications, equivalents, and alternatives falling within the scope of the present disclosures as defined by the appended claims.

Embodiments described herein relate to an inflatable building structure equipped with an enclosure inflated over a surface, designed for uses such as a children's playhouse, a greenhouse, or temporary shelter. The inflatable building structure includes an integrated cleaning mechanism featuring a detachable bag to collect and contain dust, debris, and other contaminants, preventing them from spreading inside the inflatable building structure. The detachable nature of the bag allows for easy removal, emptying, and cleaning, offering an efficient solution for maintaining cleanliness. The cleaning mechanism is designed to capture contaminants without disrupting the utility or use of the inflatable building structure.

Figure 1A:
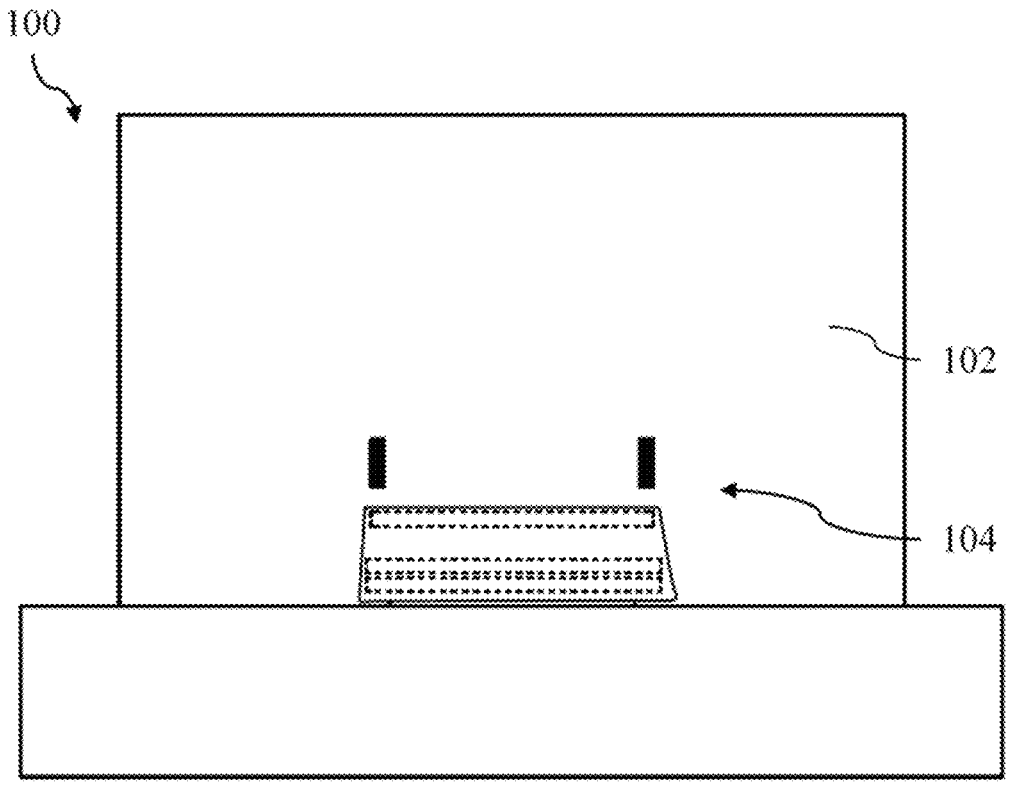
FIGS. 1A to 1C illustrate exemplary front views of an inflatable building structure, in accordance with an embodiment of the present disclosure.
Figure 1B:
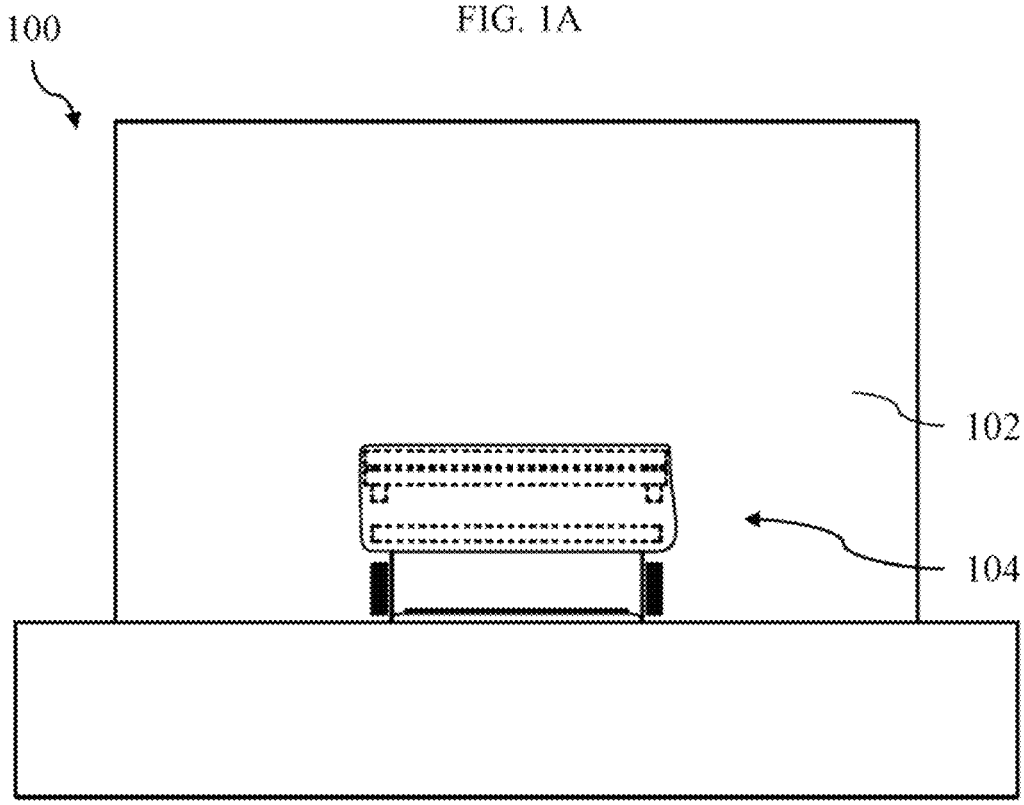
Figure 1C:
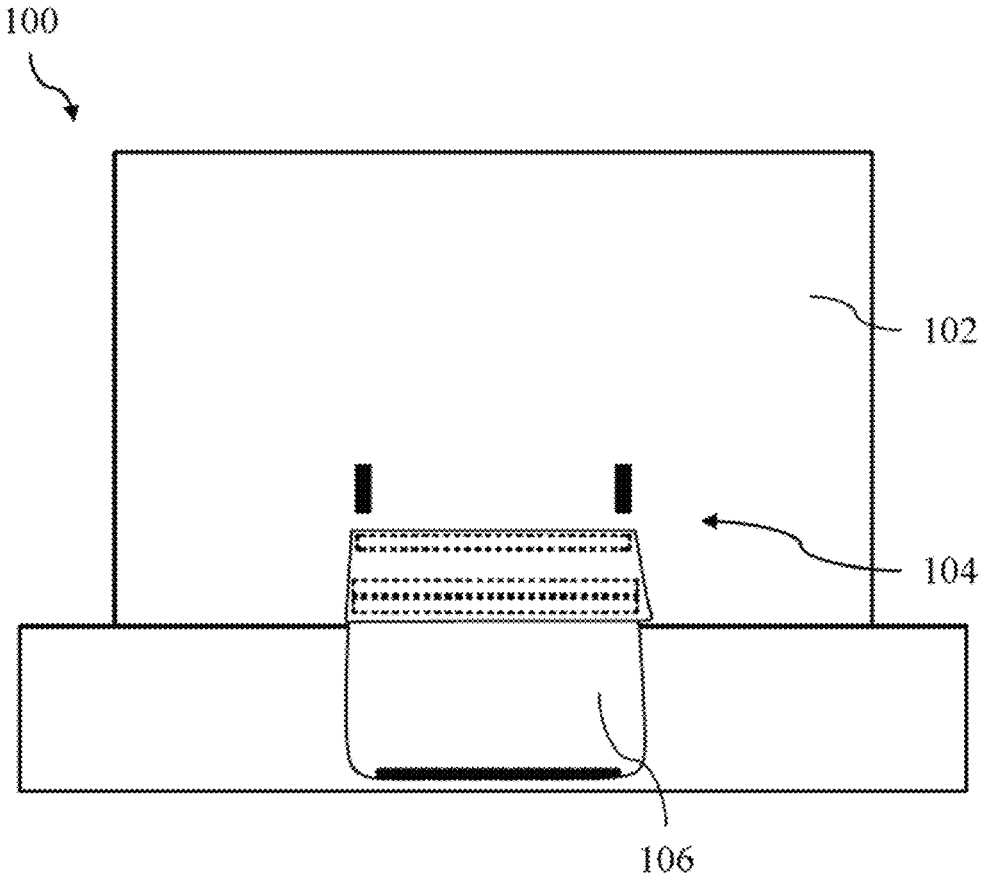

FIGS. 1A to 1C illustrate exemplary front views of an inflatable building structure (also referred to as "inflatable structure" herein) 100. The inflatable structure 100 may be adapted for use as a playhouse for children, a greenhouse, or a building primarily utilized for the temporary shelter of people, recreational activities, or other space-efficient purposes requiring a lightweight, portable, and easily deployable structure. The inflatable structure 100 includes at least one enclosure 102 made of a fluid impermeable fabric or a semi-impermeable fabric, for example, mesh, deployed above a surface that is separate from the fluid impermeable fabric to form an enclosed space bounded by the fluid impermeable fabric and the surface. In an exemplary embodiment, the enclosure 102 may include one or more bouncing surfaces enclosed by a plurality of walls, to serve as a playing area for children. The enclosure 102 may be configured to receive a fluid from an inflator device to form the enclosed space that includes the one or more bouncing surfaces enclosed by the walls.

The inflatable structure 100 includes a cleaning assembly 104 for draining one or more contaminants, including dust, debris, fluids, or other particulate matter, from the enclosed space bounded by the enclosure 102. The cleaning assembly 104 allows a container or a bag 106 to be detachably secured to an exterior of the enclosure 102, to facilitate removal and collection of the one or more contaminants by the container 106.

Figure 2A:
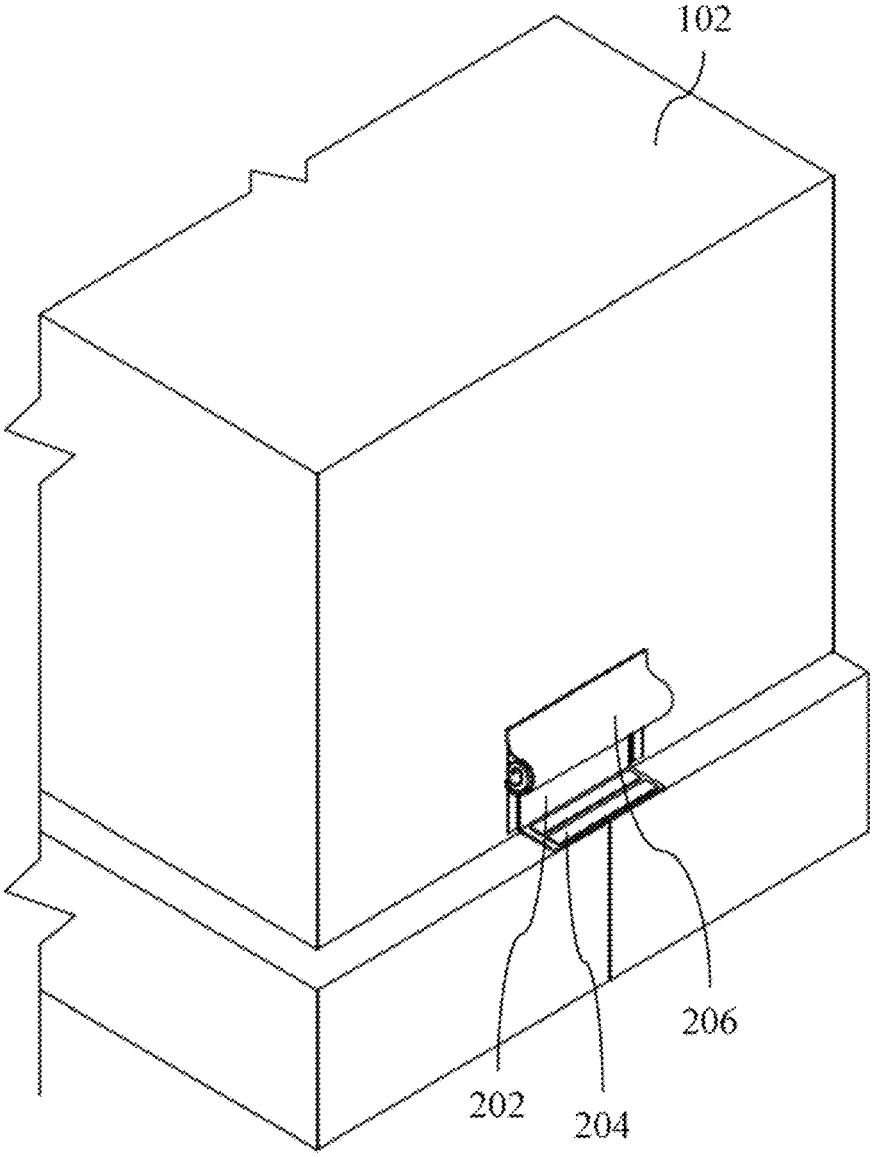
FIGS. 2A to 2D show exemplary perspective views of an exterior of at least one enclosure of the inflatable building structure equipped with a cleaning assembly, in accordance with an embodiment of the present disclosure.
Figure 2B:
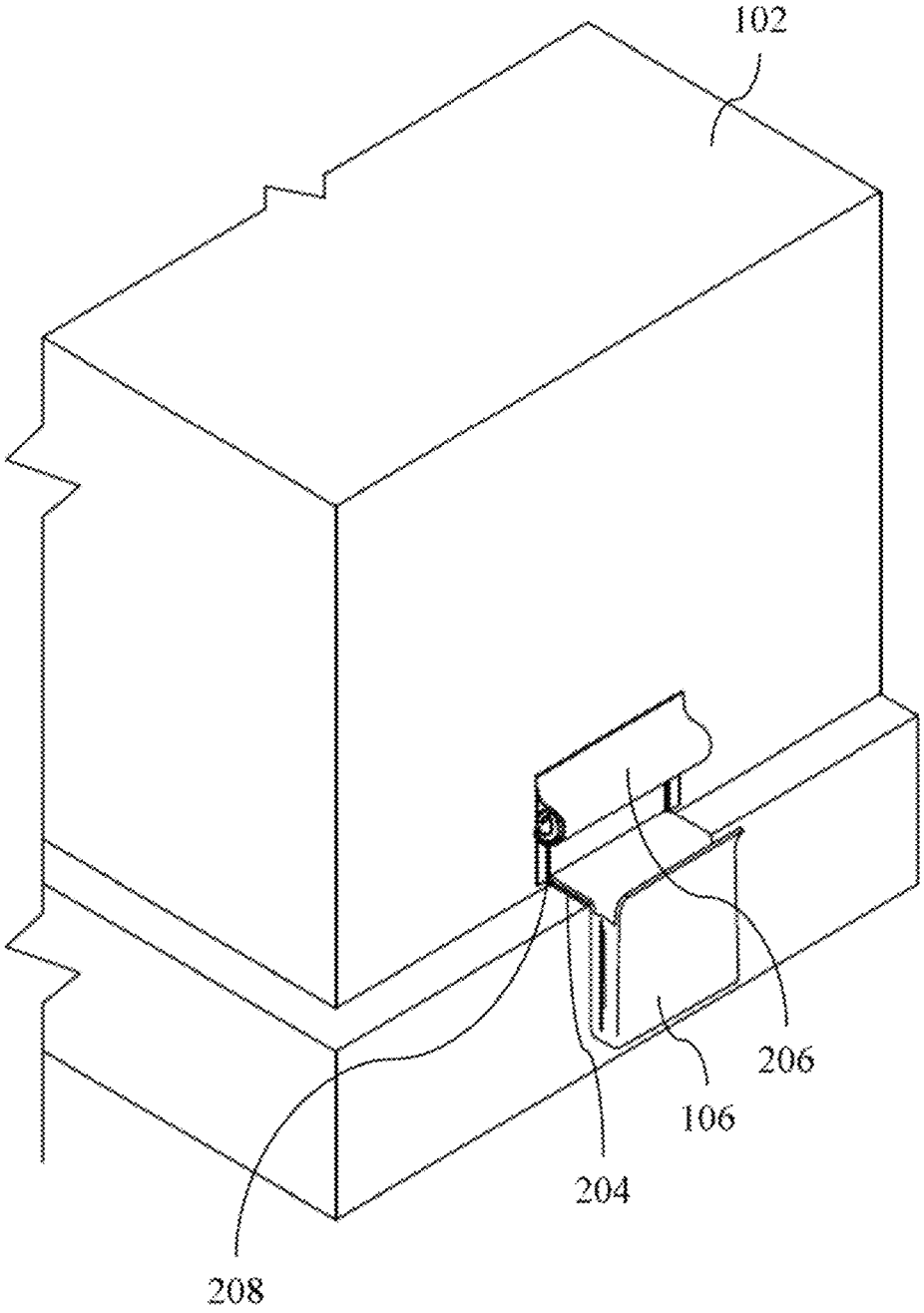
Figure 2C:
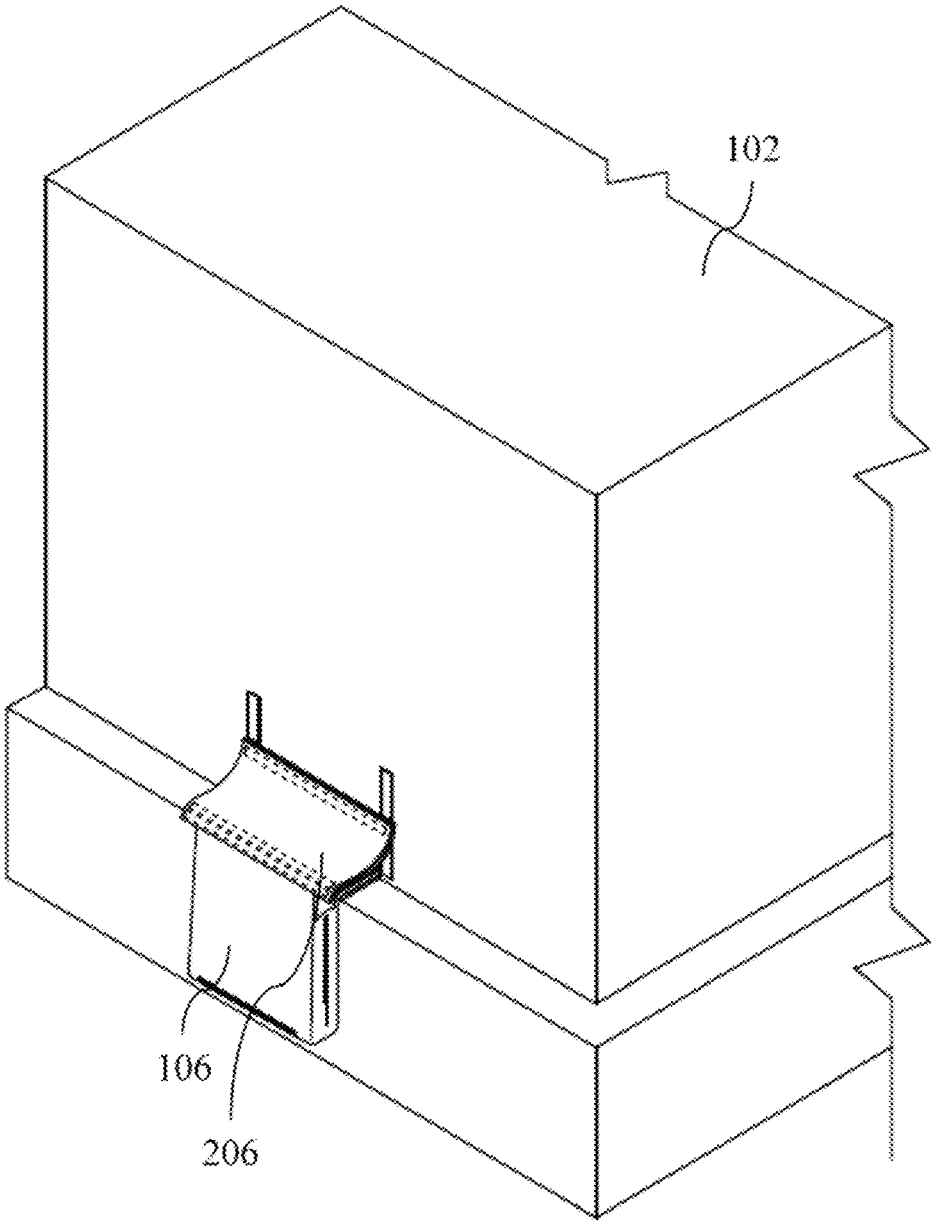
Figure 2D:
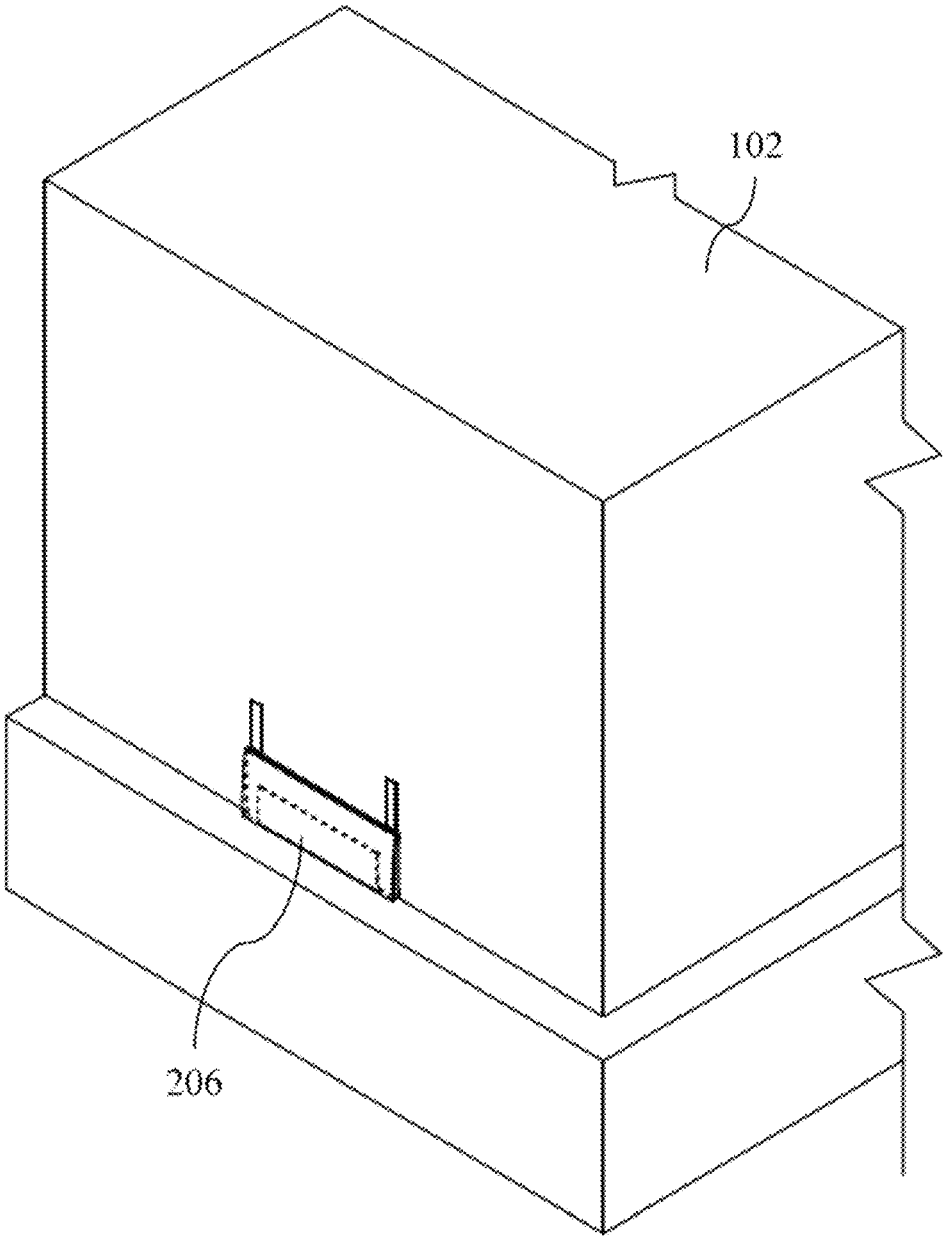

FIGS. 2A to 2D show exemplary perspective views of the exterior of the enclosure 102 of the inflatable structure 100 equipped with the cleaning assembly 104. The cleaning assembly 104 includes at least one first opening 202 formed on the exterior of the enclosure 102, as shown in FIG. 2A. The cleaning assembly 104 also includes a first attachment mechanism 204 positioned on any of an interior or an exterior of the enclosure 102, as shown in FIG. 2B, configured to detachably secure the removable container 106 for receiving the one or more contaminants from the enclosed space of the enclosure 102. In an exemplary embodiment, the first opening 202 may be formed on an outer surface of at least one wall of the enclosure 102. The first attachment mechanism 204 may be positioned at an inner surface of the at least one wall, and may include one or more hook-and-loop fastening elements (i.e., Velcro straps) attached to the inner surface of the at least one wall. The first opening 202 may be appropriately sized to substantially prevent a user from entering or exiting the one or more bouncing surfaces of the enclosure 102 therefrom. In an exemplary embodiment, the first attachment mechanism 204 may be configured to detachably secure at least one door 206 adapted to selectively open or close the first opening 202 when the container 106 is attached to the enclosure through the first attachment mechanism, as shown in FIGS. 2B and 2C, respectively. The door 206 may be made of a flexible material, and may be secured to the exterior of the enclosure's wall through the first attachment mechanism 204 such that the door 206 is movable between a retracted position to open the first opening 202 to expose the enclosure's interior to an outside environment thereof, and an extended position to enable closing of the first opening 202. Referring to FIG. 2D, the door 206 is easily movable from the retracted position to the extended position to close the first opening 202, when the container 106 is detached from the enclosure 102.

The first opening 202 may include a second attachment mechanism 208 positioned on an exterior or an interior of the at least one door 206 to facilitate the first attachment mechanism 204 in detachably securing the container 106. As shown in FIG. 3C, the at least one door 206 includes two doors with a first door positioned between first opening 202 and a second door when the at least one door 206 closes first opening 202. The second attachment mechanism 208 may include one or more hook-and-loop fastening elements (i.e., Velcro straps) attached to any of the exterior and the interior of the door 206. As shown in FIG. 3D, second attachment mechanism 208 includes a first fastening element 207 positioned on an exterior of a first door of the at least one door 206 and a second fastening element 209 positioned on an interior of a second door of the at least one door 206.

The cleaning assembly 104 may include at least one second opening (not shown) formed on an exterior of the enclosure 102 to allow a user to enter the enclosed space and transfer the one or more contaminants to the container 206. In an exemplary embodiment, the second opening may be formed on an outer surface of at least one wall of the enclosure 102 to allow the user to enter or exit the one or more bouncing surfaces of the enclosure 102. In an exemplary embodiment, the second opening may be positioned on the outer surface of the at least one wall of the enclosure 102 such that an edge of the second opening is substantially coplanar with the one or more bouncing surfaces, with a length sufficient to enable removal of the one or more contaminants from the one or more bouncing surfaces.

The container 106 may include one or more third attachment members 210 configured to securely attach with the first attachment mechanism 204 and the second attachment mechanism 208. The third attachment member 210 may include one or more hook-and-loop fastening elements (i.e., Velcro members) positioned at any of an inner surface and an outer surface of the container 106. As shown in FIG. 3D, third attachment mechanism 210 includes a first fastening element 211 disposed on an outer surface of a first flap of the container 106, a second fastening element 212 disposed on an inner surface of a second flap of the container 106, and a third fastening element 213 disposed on an outer surface of the second flap of the container 106. As shown in FIG. 3E, the first fastening element 211 of the third attachment mechanism 210 is configured to attach with the first attachment mechanism 204, the second fastening element 212 of the third attachment mechanism 210 is configured to attach with the first fastening element 207 of the second attachment mechanism 208, and the third fastening element 213 of the third attachment mechanism 210 is configured to attach with the second fastening element 209 of the second attachment mechanism 208.

Figure 3A:
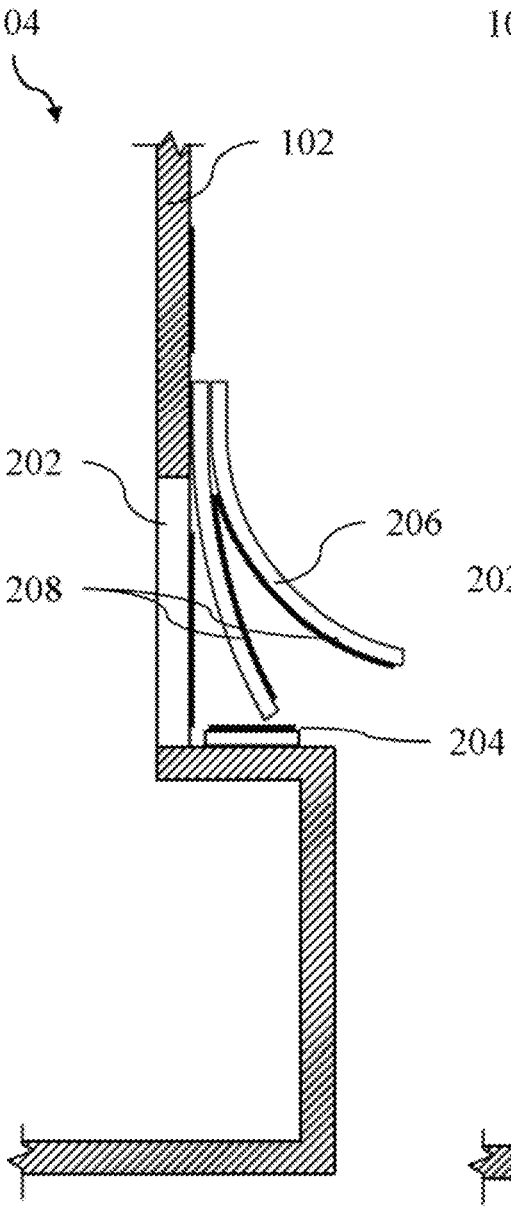
FIGS. 3A to 3E show exemplary sectional views of the cleaning assembly, in accordance with an embodiment of the present disclosure.
Figure 3B:
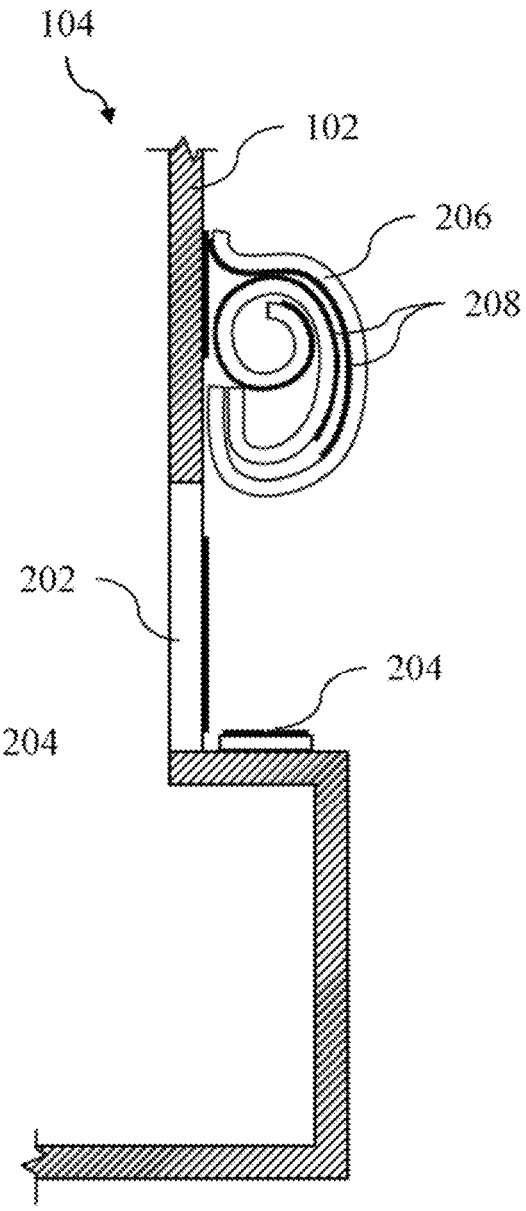
Figure 3C:
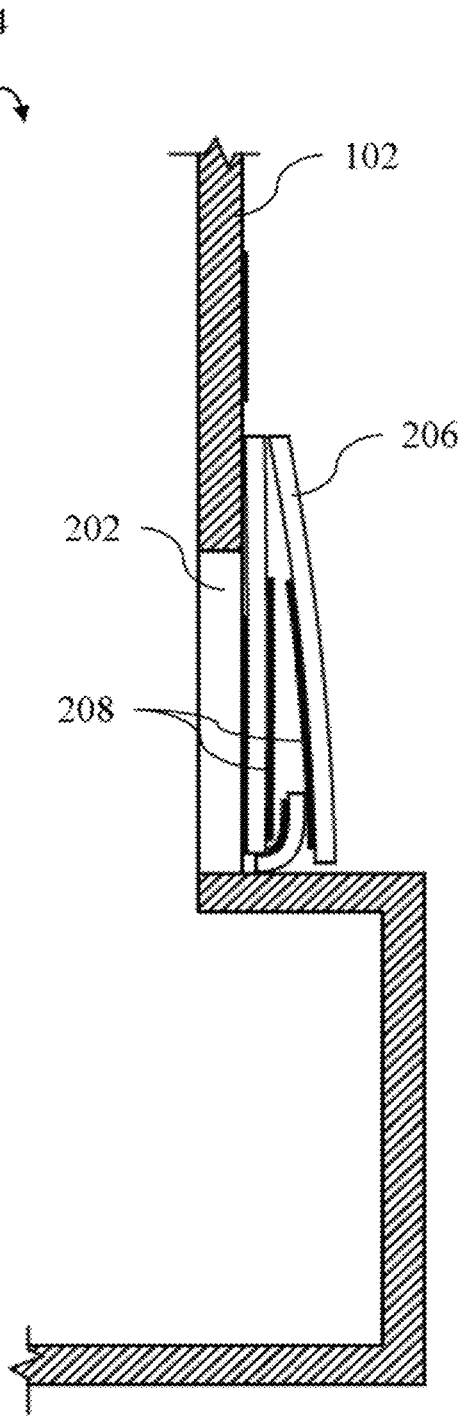
Figure 3D:
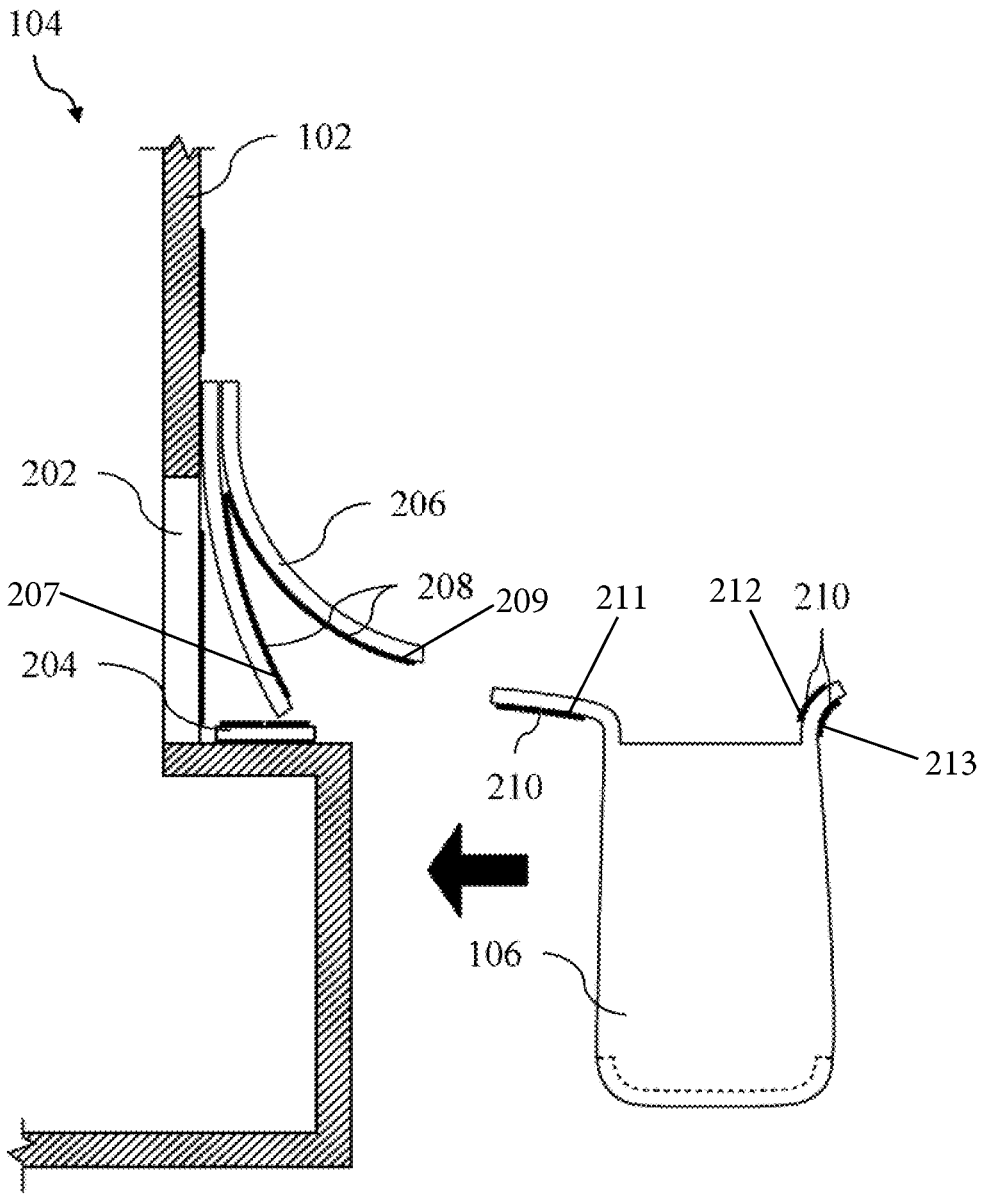
Figure 3E:
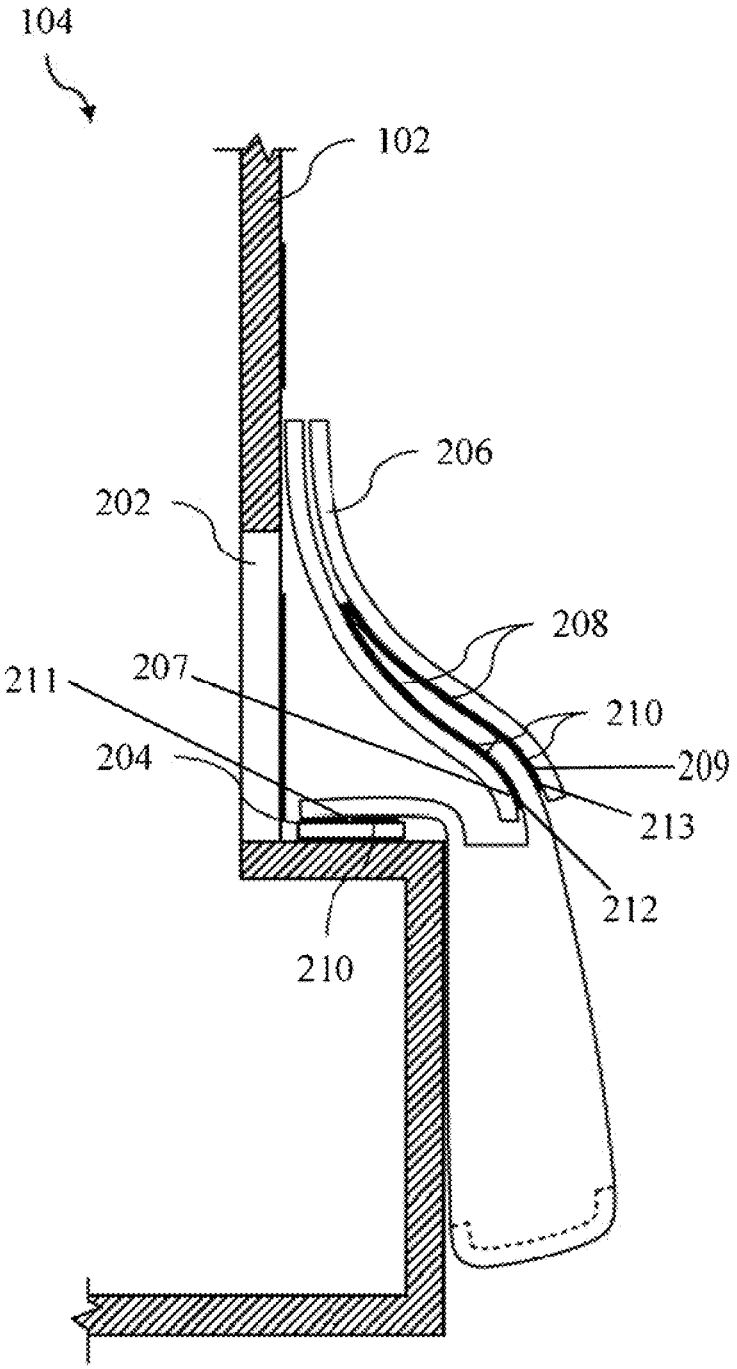

FIG. 3A shows an exemplary sectional view of the door 206 in its extended position, in which the door 206 closes the first opening 202 present on the wall of the enclosure 102. The door 206 can be easily moved from its extended position to the retracted position, as shown in FIG. 3B, by simply folding or moving the door 206. FIG. 3C illustrates another exemplary sectional view of the door 206 in its extended position. FIG. 3D shows an exemplary sectional view of the cleaning assembly 104 depicting attachment of the container 106 to the enclosure 102 through engagement of the third attachment mechanism 210 with the first and second attachment mechanisms 204, 208. FIG. 3E illustrates an exemplary sectional view of the cleaning assembly 104 showing the container 106 completely attached to the enclosure 102 through engagement of the third attachment mechanism 210 with the first and second attachment mechanisms 204, 208.

Figure 4A:
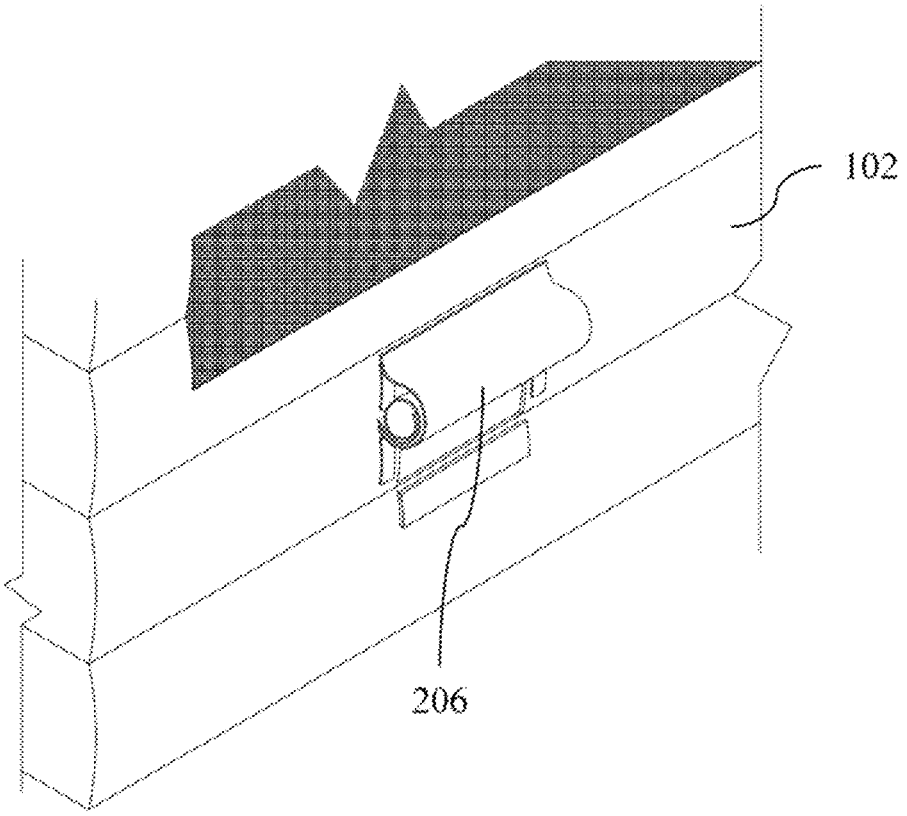
FIGS. 4A and 4B illustrate exemplary perspective views of at least one door of the cleaning assembly adapted to selectively open or close a first opening formed on the exterior of the enclosure, in accordance with an embodiment of the present disclosure.
Figure 4B:
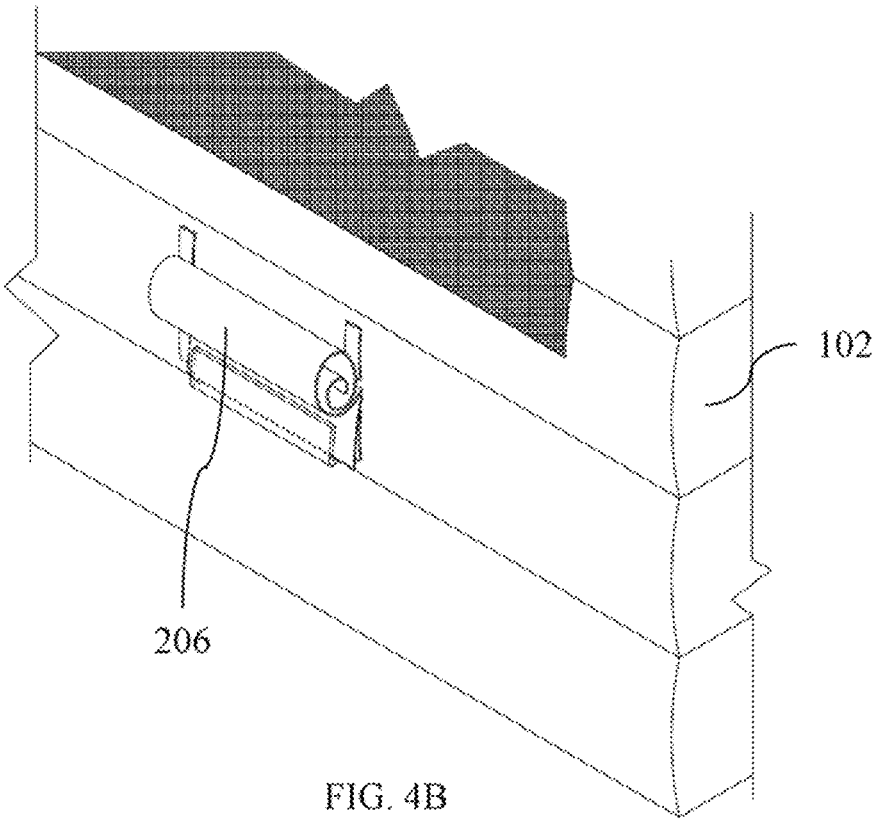
Figure 5A:
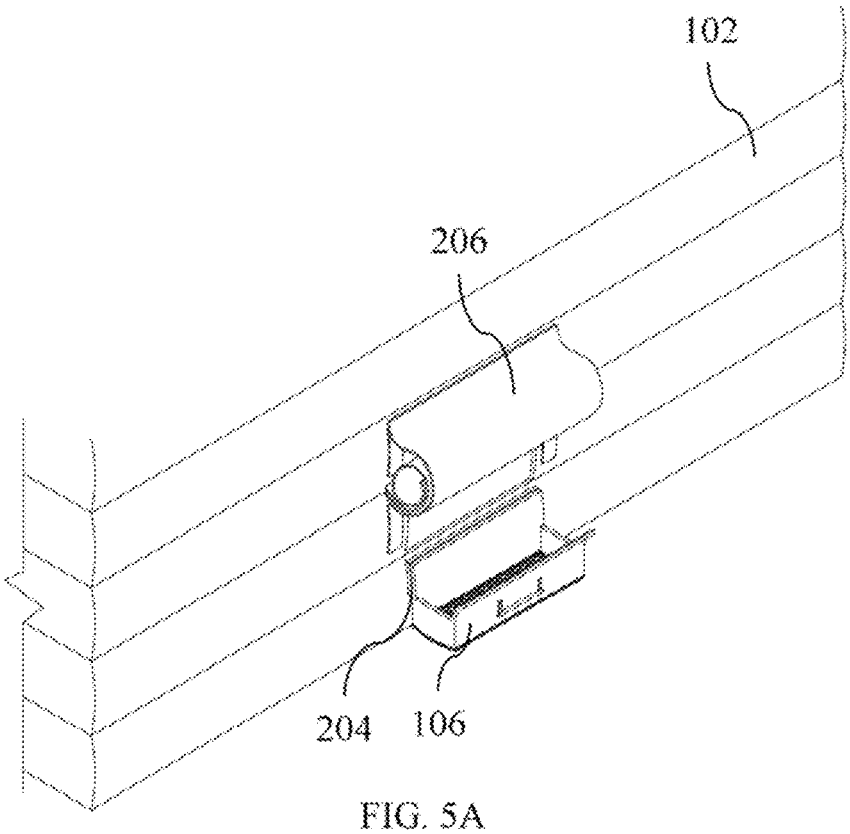
FIGS. 5A and 5B illustrate exemplary perspective views of a container/bag detachably secured with the first opening formed on the exterior of the enclosure, in accordance with an embodiment of the present disclosure.
Figure 5B:
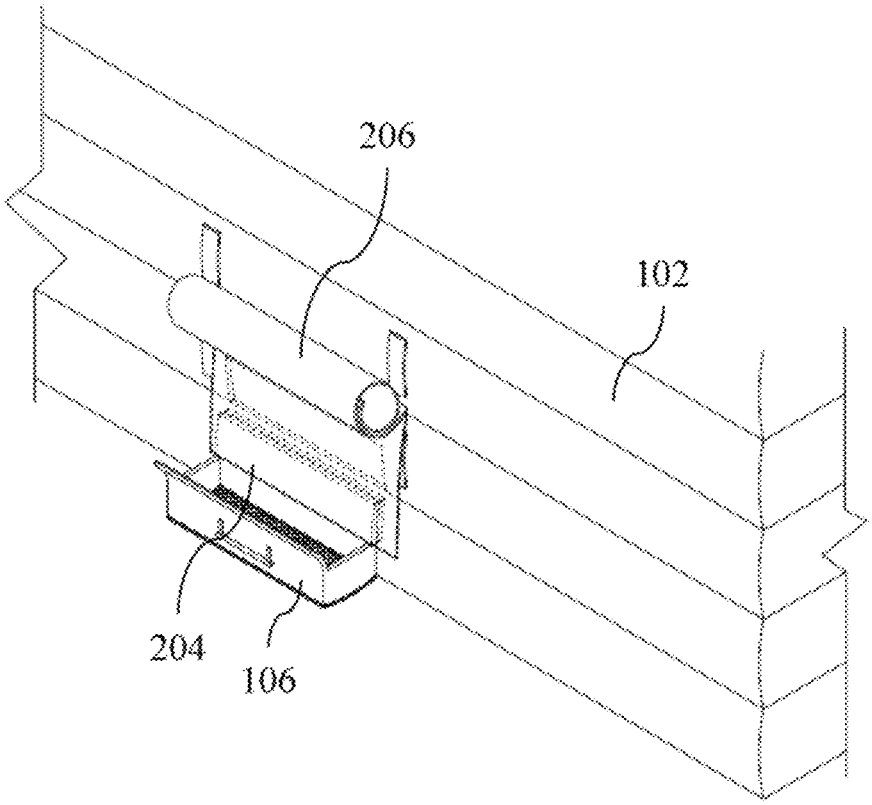

Referring now to FIGS. 4A and 4B, the at least one door 206 of the cleaning assembly 104 can be moved between the retracted and extended positions to selectively open or close the first opening 202 formed on the exterior of the enclosure 102. FIGS. 5A and 5B show exemplary perspective views of the container/bag 106 detachably secured with the first opening 202.

FIGS. 6A to 6E illustrate various exemplary representations of the container 106 that can be removably secured with the first opening 202 to facilitate easy and efficient collection of contaminants from the enclosed space of the enclosure 102. The container 106 may include at least one of a bag, a pouch and a garbage disposal bag. The container 106 may include the one or more third attachment members 210 that facilitate the container 106 to be detachably secured with the enclosure 102 and/or the door 206 through engagement with the first attachment mechanism 204 and the second attachment mechanism 208. The third attachment member 210 may include one or more hook-and-loop fastening elements (i.e., Velcro members) positioned at any of an inner surface and an outer surface of the container 106. In an exemplary embodiment, at least a portion 602 of the container 106 may be formed of a mesh material, as shown in FIGS. 6A to 6E, which includes a network of interconnected strands or fibers arranged in a grid-like pattern. This portion 602 of the container 106 allows for some form of permeability, such as airflow, water flow, or light penetration, while still maintaining a barrier to larger objects or particles, such as dust or debris.

Figure 6A:
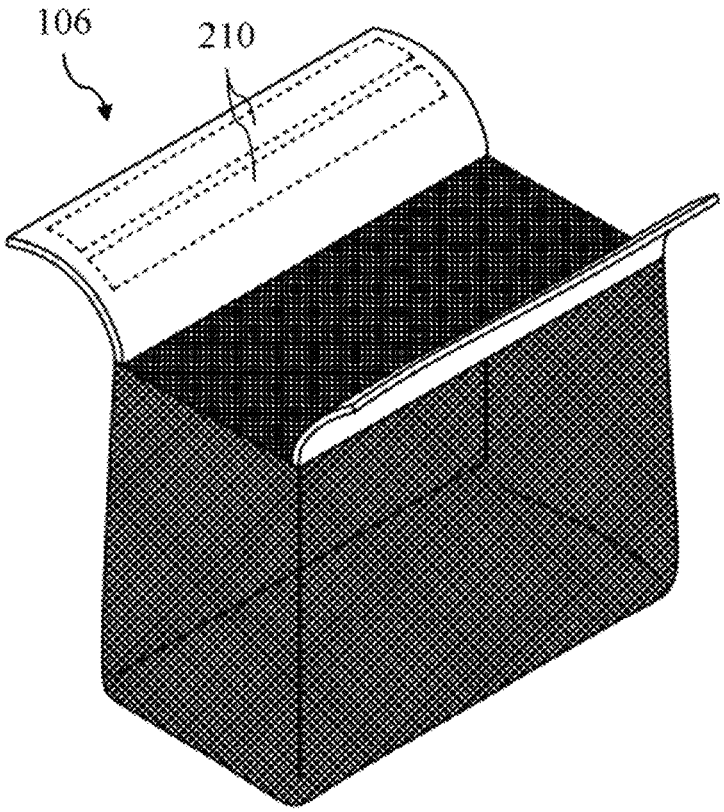
FIGS. 6A to 6E illustrate various exemplary representations of the container removably secured with the first opening, in accordance with an embodiment of the present disclosure.
Figure 6B:
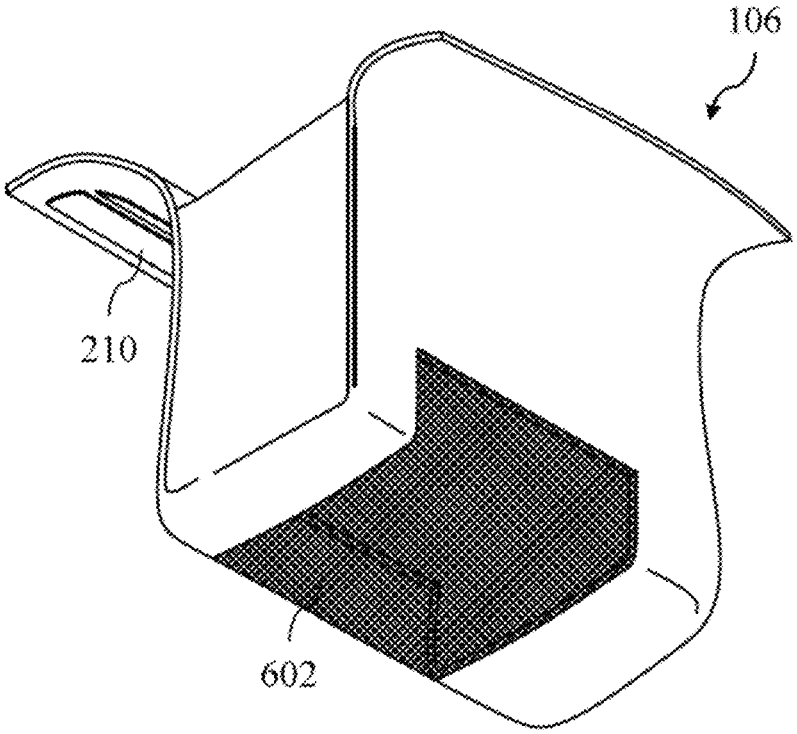
Figure 6C:
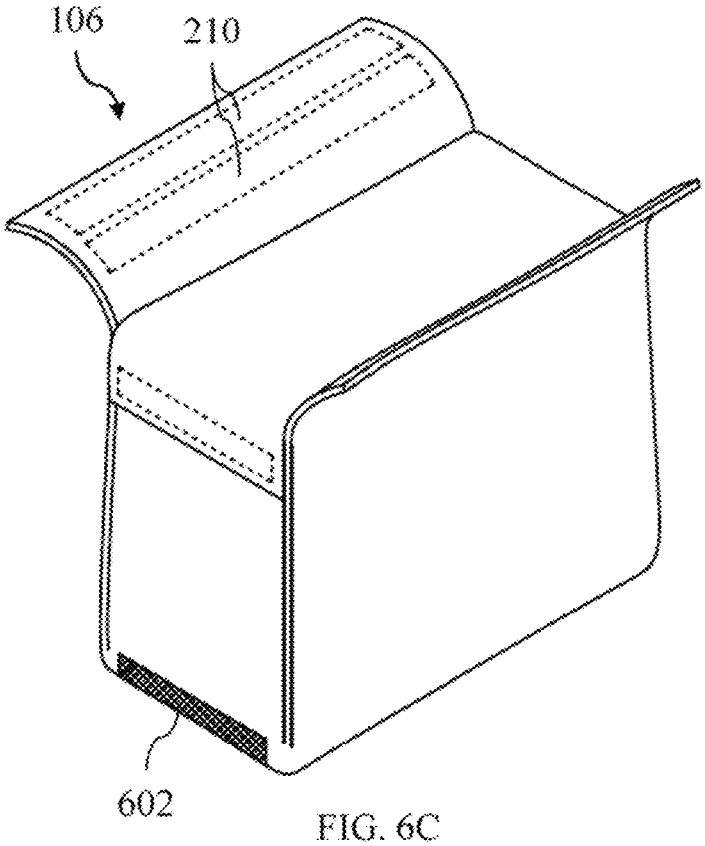
Figure 6D:
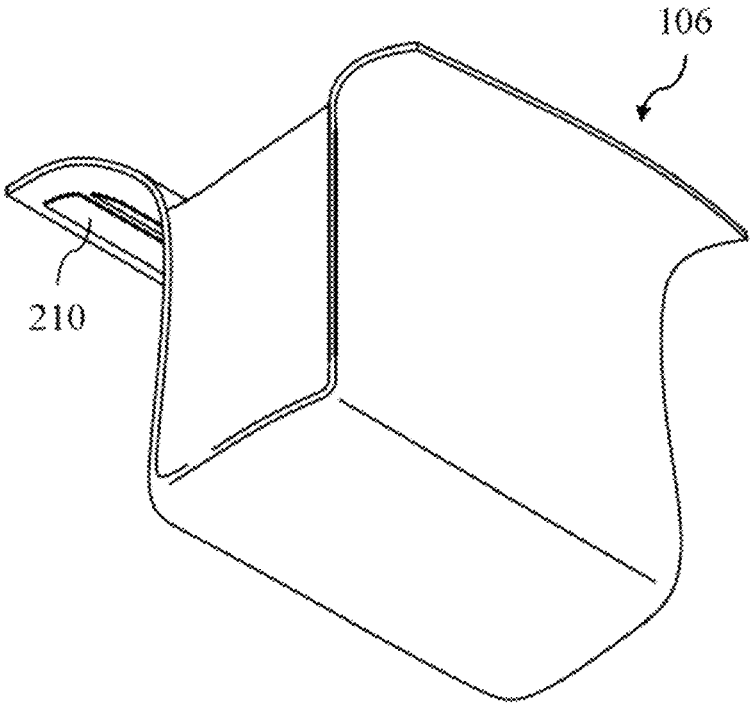
Figure 6E:
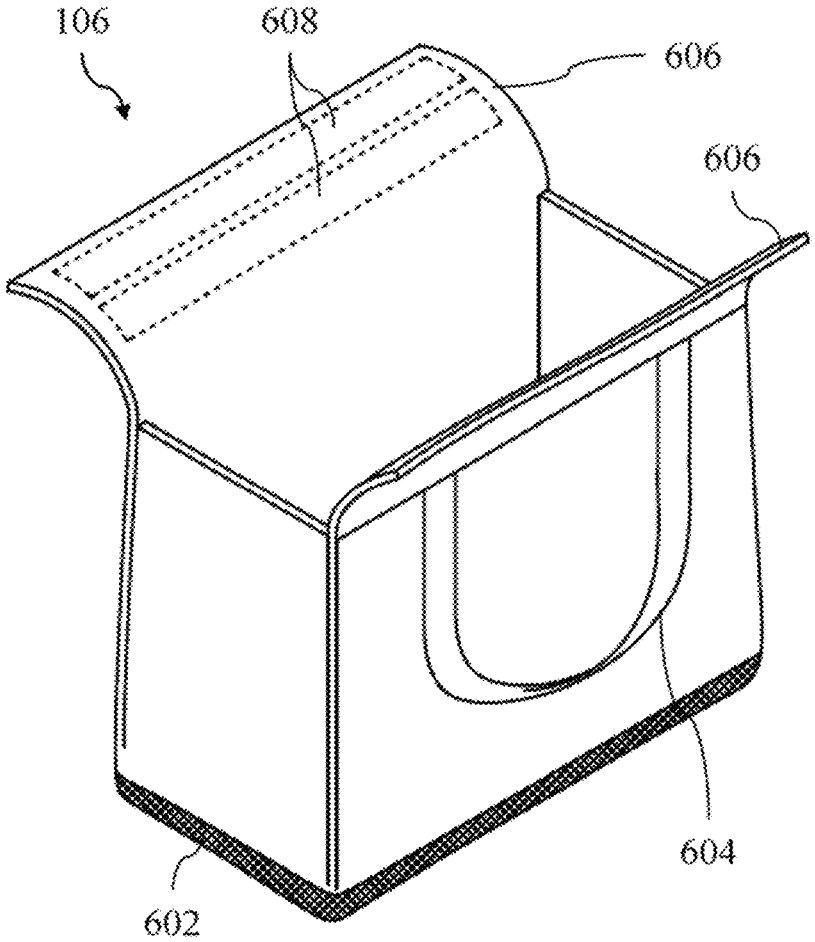

As depicted in FIG. 6E, the container 106 may be configured with one or more straps 604 on both its lateral sides, allowing it to be easily carried to a different location for emptying its contents. The straps 604 may vary in length, with an adjustable length feature being preferable for convenience. Additionally, the container 106 may include a shoulder carrying strap (not shown), providing an alternative carrying option. Furthermore, as illustrated in FIG. 6E, the container 106 may be equipped with flaps 606 at its upper portions. These flaps 606 serve to securely close the cavity of the container 106, ensuring that its contents remain contained during transport from one place to another. This design prevents any spillage of debris or contaminants while the container is being moved to another location for emptying. Each of the flaps 606 may be equipped with an attachment mechanism, which can include a variety of fastening options such as hook-and-loop fastening elements (i.e., Velcro straps) 608 or alternatively buttons, snaps, hooks, or other similar mechanisms. The flaps 606 make it easy to open and close the cavity of the container 106, ensuring safe and secure transportation.

Thus, the present disclosure provides a practical and user-friendly solution to the persistent issue of cleanliness and maintenance in inflatable structures, such as inflatable playhouses. Recognizing the challenges of keeping such structures free from dust, debris, and other contaminants, the inflatable structure of the present invention introduces a detachable container that can easily be removed, emptied, and cleaned. This setup not only simplifies the cleaning process but also contributes to a safer environment for users.

While the foregoing describes various embodiments of the invention, other and further embodiments of the invention may be devised without departing from the basic scope thereof. The scope of the invention is determined by the claims that follow. The invention is not limited to the described embodiments, versions or examples, which are included to enable a person having ordinary skill in the art to make and use the invention when combined with information and knowledge available to the person having ordinary skill in the art.

The invention claimed is:

1. An inflatable building structure, comprising:

at least one enclosure; and a cleaning assembly for draining one or more contaminants from the at least one enclosure, wherein the cleaning assembly comprises:

a first opening formed on an exterior of the at least one enclosure;

a first attachment mechanism positioned on an exterior of the at least one enclosure;

a container configured to be detachably secured to the at least one enclosure, the container configured to receive the one or more contaminants from the at least one enclosure through the first opening;

at least one door adapted to close the first opening when the container is detached from the first attachment mechanism;

a second attachment mechanism comprising:

a first fastening element positioned on an exterior of a first door of the at least one door; and a second fastening element positioned on an interior of a second door of the at least one door; and a third attachment mechanism positioned on the container and configured to attach with the first attachment mechanism and the second attachment mechanism to detachably secure the container to the at least one enclosure, wherein the third attachment mechanism comprises:

a first fastening element disposed on an outer surface of a first flap of the container, the first fastening element of the third attachment mechanism configured to attach with the first attachment mechanism;

a second fastening element disposed on an inner surface of a second flap of the container, the second fastening element of the third attachment mechanism configured to attach with the first fastening element of the second attachment mechanism; and a third fastening element disposed on an outer surface of the second flap of the container, the third fastening element of the third attachment mechanism configured to attach with the second fastening element of the second attachment mechanism.

2. The inflatable building structure as claimed in claim 1, wherein the container comprises one or more straps.

3. The inflatable building structure as claimed in claim 2, wherein the one or more straps are disposed at lateral sides of the container.

4. The inflatable building structure as claimed in claim 1, wherein the at least one enclosure comprises a plurality of walls.

5. The inflatable building structure as claimed in claim 4, wherein the first opening is formed on an outer surface of at least one of the plurality of walls.

6. The inflatable building structure as claimed in claim 4, wherein the at least one door is configured to be moved from a retracted position to an extended position, wherein the at least one door closes the first opening when in the extended position.

7. The inflatable building structure as claimed in claim 1, wherein the first attachment mechanism comprises one or more hook-and-loop fastening elements.

8. The inflatable building structure as claimed in claim 1, wherein the first opening is sized to prevent a user from entering or exiting the at least one enclosure.

9. The inflatable building structure as claimed in claim 1, wherein the first door of the at least one door is positioned between the first opening and the second door of the at least one door when the at least one door closes the first opening.

10. The inflatable building structure as claimed in claim 1, wherein the second attachment mechanism comprises one or more hook-and-loop fastening elements.

11. The inflatable building structure as claimed in claim 1, wherein the third attachment mechanism comprises one or more hook-and-loop fastening elements.

12. The inflatable building structure as claimed in claim 1, wherein the container comprises at least one of a bag, a pouch and a garbage disposal bag.

13. The inflatable building structure as claimed in claim 1, wherein the first flap and the second flap of the container are configured to close the container.

14. The inflatable building structure as claimed in claim 1, wherein at least a portion of the container is formed of a mesh material.

15. The inflatable building structure as claimed in claim 1, wherein the first flap and the second flap of the container are disposed at upper portions of the container.

* * * * *